United States Patent [19]

Netupsky

[11] 4,420,915

[45] Dec. 20, 1983

[54] LARGE-PANEL CONCRETE WALL BEARING COMPONENTS

[75] Inventor: Boris Netupsky, Vancouver, Canada

[73] Assignee: Dyform Engineering Ltd., Canada

[21] Appl. No.: 140,370

[22] Filed: Apr. 14, 1980

[30] Foreign Application Priority Data

Apr. 18, 1979 [CA] Canada ..... 325689

[51] Int. Cl.[3] ..... E04B 1/92

[52] U.S. Cl. ..... 52/98

[58] Field of Search ..... 52/1, 98, 396, 99, 235; 49/141, 466

[56] References Cited

U.S. PATENT DOCUMENTS

| | | | |
|---|---|---|---|
| 1,333,508 | 3/1920 | Schopflocher | 52/99 |
| 2,358,143 | 9/1944 | Castor | 52/1 |
| 2,509,362 | 5/1950 | Miller | 49/141 |
| 3,112,535 | 12/1963 | Kinney | 52/1 |
| 3,238,682 | 3/1966 | Tracy | 52/99 |
| 3,258,890 | 7/1966 | Dirkse | 52/1 |

FOREIGN PATENT DOCUMENTS 1284731 8/1972 United Kingdom .

*Primary Examiner*—John E. Murtagh

*Attorney, Agent, or Firm*—Townsend and Townsend

[57] ABSTRACT

A concrete wall bearing component having one or more relatively large failure panel sections therein each defined by a thin weakness band and being of such size as to blow out of the panel along the weakness band when subjected to a blast, while leaving enough of the panel to support the load normally supported by the panel, and a wall formed of said bearing components. The invention differs from the prior art in making lighter panels not by increasing the strength and thus the weight.

13 Claims, 11 Drawing Figures

LARGE-PANEL CONCRETE WALL BEARING COMPONENTS

FIELD OF THE INVENTION

This invention relates to bearing components for concrete walls of the large-panel type.

DESCRIPTION OF THE PRIOR ART

Like most buildings, large-panel structures must be designed to perform safely taking into account all relevant loads, effects, and phenomena that are likely to affect the structure.

Abnormal loads, such as gas or bomb explosions, are rarely considered in the design of these structures. Current consideration of abnormal loadings concedes that failure of individual structural elements, or collapse of a restricted portion of a building, because of an abnormal load, will be acceptable, so long as this local failure does not trigger a chain reaction leading to progressive collapse of a substantial part of the building.

Structure safety in large-panel construction with respect to abnormal loadings may be measured by the ability of the structure to resist progressive collapse.

The current practice, following procedures outlined in various building codes, is to build additional strength into the structure as a whole in such a way as to prevent progressive collapse of a significant portion of the structure in the event of failure of a relatively small, but structurally critical, member of the structure. These additional strength features include provision of continuity where possible, peripheral and transverse ties at each floor and the incorporation of additional reinforcement throughout the structure to cope with the loss of any one large-panel bearing member.

Since it is a requirement of the various codes to consider the loss of any one large-panel component of a structure, it is clear that this would result in considerable additional costs to satisfy all possible loading conditions after the failure of one large-panel bearing wall.

SUMMARY OF THE INVENTION

An object of the present invention is the provision of large-panel concrete wall bearing components that eliminate or greatly reduce any additional consideration needed for the rest of the building structure, as in current practice, by having the entire safety feature built into each large-panel bearing wall at little, no or less costs, depending on whether the design authority chooses to reinforce the area of the panel which would be designed to fail.

The basic component of this invention is a large concrete bearing panel having at least one failure panel section therein each defined by a thin weakness band. Each failure section is of such size as to blow out of the panel along the weakness band thereof when subjected to a blast, while leaving enough of the bearing panel to continue to support the load normally carried by the panel. If desired, hinge means may be provided for each failure section. For example, the bearing panel may have reinforcement bars embedded in the concrete thereof at each of its failure sections, these bars extending from the bearing panel into the failure section along one side, for example, the upper edge, of the latter so as to act as a hinge therebetween in the event of a blow-out.

A large-panel concrete wall bearing component according to the present invention comprises a large concrete bearing panel to rest on a lower edge thereof on a support and to carry a load on an upper edge, said panel having at least one failure panel section therein each defined by a thin weakness band extending cross-sectionally between opposite faces of the bearing panel, said failure section being of such size as to blow out of the panel along the weakness band when subjected to a blast, while leaving enough of the bearing panel to continue to support said load.

BRIEF DESCRIPTION OF THE DRAWINGS

This invention is illustrated by way of example in the following drawings, in which.

DESCRIPTION OF THE PREFERRED EMBODIMENTS

Figure 1:
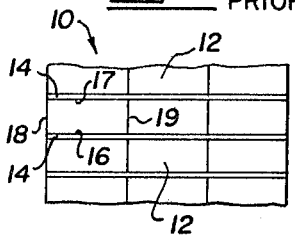
Fig. 1. PRIOR ART
FIG. 1 diagrammatically illustrates a standard large-panel concrete bearing wall.

Referring to FIG. 1 of the drawings, 10 is a standard large-panel concrete bearing wall made up of a plurality of large concrete bearing panels 12 standing on edge. The floors 14 of the building structure extend between the top and bottom edges of the panels 12 at the required levels of the building. Each panel 12 is of rectangular formation and has a lower edge 16, an upper edge 17 and side edges 18 and 19. The lower edge of each bearing panel rests on a support, while the upper edge thereof carries a load. In the illustrated example, the lower edge 16 of each panel 12 rests on a support, which may be a floor 14 or a suitable foundation member, and the upper edge of each panel carries a load, which may be a floor 14 above the panel or a roof structure. The side edges of the bearing panels of each tier are grouted or otherwise secured in position in accordance with standard practice.

Figure 2:
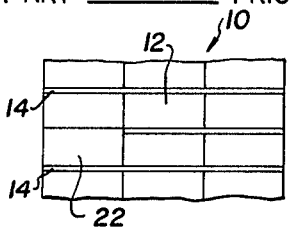
Fig. 2. PRIOR ART
FIG. 2 shows the same wall but with a bearing panel at one end of a floor removed therefrom.

FIG. 2 illustrates the wall 10 with a bearing panel 12 missing from an end of the wall. The panel may be removed by the blast of a gas or bomb explosion. In the illustrated wall, part of the floor 14 formerly supported by said panel has been blown away. The missing panel leaves a gap 22 in the wall, and the portion of the structure above the wall is subject to cantilever action. If the cantilever breaks down, the above structure drops down and this may trigger a chain reaction leading to the progressive collapse of a substantial part or all of the building.

Figure 3:
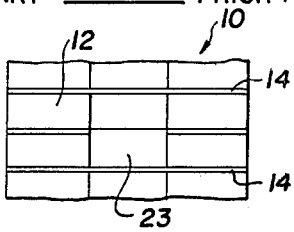
Fig. 3. PRIOR ART
FIG. 3 is a view similar to FIG. 2 showing a bearing panel removed from a different location in the wall, FIG. 4 diagramatically illustrates a large-panel concrete bearing wall with panels therein embodying this invention.

FIG. 3 illustrates the wall 10 with a panel 12 missing from the central section of the wall. This leaves a gap 23 with the structure above the gap subject to beam action. Failure of the beam may trigger a chain reaction leading to progressive collapse.

Figure 4:
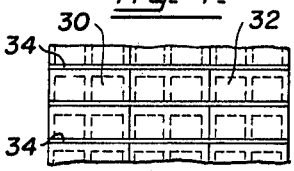
Figure 5:
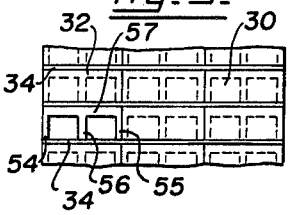
FIGS. 5 and 6 illustrate the wall of FIG. 4 with the failure sections of bearing panels in two dfferent situations removed, said Figures corresponding respectively to FIGS. 2 and 3.
Figure 6:
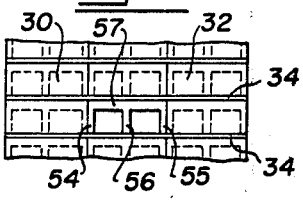
Figure 7:
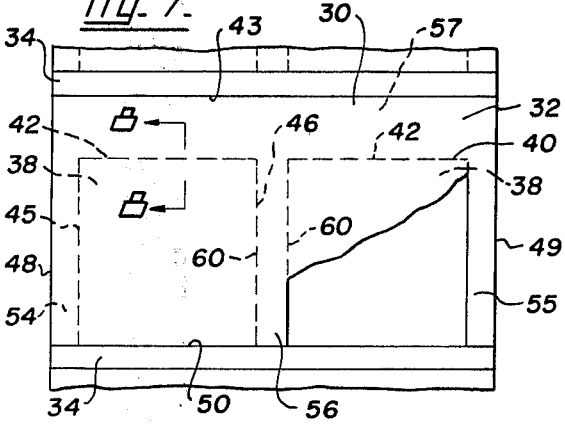
FIG. 7 is an enlarged panel embodying this invention and having two failure sections, one of which has been partly removed.

FIG. 7 illustrates a large concrete bearing panel 30 embodying the present invention, and FIGS. 4 to 6 illustrate walls 32 formed of the bearing panels with floors 34 between the different tiers thereof.

Panel 30 is formed with one or more failure panel sections 38 formed therein, the illustrated panel having two of these sections located side by side. Each failure section 38 is defined by a thin weakness band 40. Although each failure section 38 may have different shapes relative to the bearing panel, it is preferable to form each section with an upper edge 42 spaced inwardly from the upper bearing edge 43 of the panel, and side edges 45 and 46 spaced from the side edges 48 and 49 of the panel. The lower edge 50 of the panel may also constitute the lower edge of each failure section 38. The illustrated bearing panel 30 of FIG. 7 has two failure sections 38, and the outer edges 40 of these sections are spaced respectively from the side edges 48 and 49 of the panel, while inner edges 46 of said failure sections are spaced from each other. With this arrangement, panel 30 is formed with side columns 54 and 55 between the failure sections and the side edges of the panel, and a central column 56 between said sections. These columns extend downwardly from the upper horizontal portion of the bearing panel which constitutes a beam 57.

Each failure section 38 is formed by a thin weakness band 60 which extends along the top and side edges thereof. This band is embedded in the concrete forming bearing panel 30 and its failure sections 38. The weakness band 60 is formed in any desirable manner, the main thing being that the band is weaker than the surrounding concrete.

Figure 8:
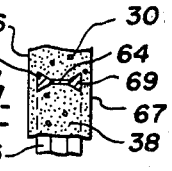
FIG. 8 is an enlarged vertical section taken on the line 8—8 of FIG. 7 and showing one weakness band arrangement.

FIG. 8 illustrates a weakness band 64 formed of suitable plastic material or the like. This band is embedded in the concrete of the bearing panel and extends cross-sectionally between the opposite faces 66 and 67 of the panel. In this example, the edges 68 of the band are near but spaced inwardly from the panel faces so that the band normally cannot be seen in the panel. If desired, the band 64 may be formed with enlargements or ribs 69 extending along the opposite edges thereof.

Figure 9:
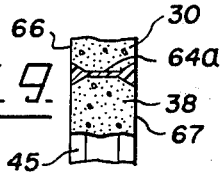
FIG. 9 is a view similar to FIG. 8 but illustrating an alternative weakness band arrangement.

FIG. 9 illustrates an alternative arrangement of the thin weakness band. In this example, band **64*a* extends at its edges to the faces 66 and 67 of bearing panel 30**. In this case, the weakness band can be seen in the panel.

Bands 64 and **64*a*** preferably have spaced perforations (not shown) to permit therethrough flow of concrete during casting. This is desirable particularly for the vertical bands.

FIG. 4 shows bearing panels 30 arranged in tiers and resting upon and supporting floors 34. The bearing panels are grouted or otherwise secured in position between the floors, and the wall 32 functions in the same manner as wall 10 described above. In this regard the bases of the columns 54, 55 and 56 are firmly located to floor 34 in conventional manner, for example with good grout. However, the bases of the failure sections 38 are relatively weakly located to floor 34. For example, with weak fill able to provide a seal but not to prevent movement of the failure section 38 when movement is required.

In FIG. 5, the failure sections 38 of the bearing panel 30 at the end of a tier or floor have been blown out. At this time, columns 54, 55 and 56 support beam 57, and these elements continue to provide support for the building structure above this bearing panel. Thus there is no or very little likelihood of a chain reaction leading to progressive collapse of any part of the builidng structure.

FIG. 6 illustrates a bearing panel 30 spaced from the ends of a tier or floor and having its failure sections blown out. Here again, the beam 57 and columns 54, 55 and 56 provide a beam structure to carry the load above the affected bearing panel.

It is desirable in the case of an explosion to prevent any failure section which is subjected to a blast from being blown away from the building structure, and thereby preventing damage by the flying section. It is desirable to provide each failure section with a hinge arrangement which will allow the section to swing away from the blast while remaining connected to the bearing panel.

Figure 10:
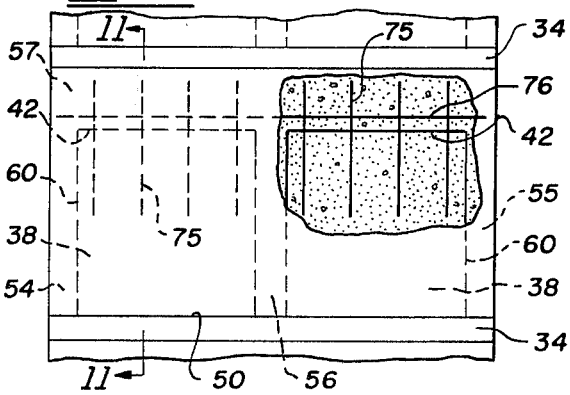
FIG. 10 is an elevation of a bearing panel of this invention incorporating a hinge arrangement for each failure section thereof.
Figure 11:
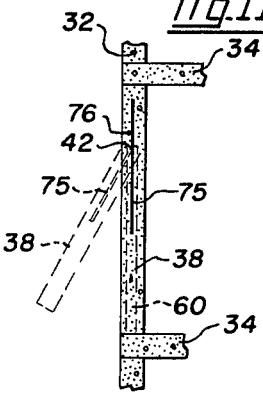
FIG. 11 is a vertical section taken on the line 11—11 of FIG. 10.

FIGS. 10 and 11 illustrate one form of hinge for a failure section of a bearing panel. A plurality of spaced-apart reinforcement rods or bars 75 are embedded in the concrete panel and the failure section at an edge of the latter and terminate in the section. In this example, the reinforcement bars extend across the upper edge 42 of the failure section.

When the failure section 38 having hinge bars 75 therein is subjected to a blast, these bars will bend, as shown in broken lines in FIG. 11, to allow the section to swing outwardly to relieve the blast pressure, but will keep the section connected to the bearing panel. A horizontal reinforcing bar 76 is positioned to strengthen the panel above the upper edges 42 of failure sections 38.

Each large bearing panel is provided with lines of weakness along which any failure will occur, with the remaining parts of the panel able to cope with the resulting load re-distribution in the building structure. If desired, each bearing panel and its failure section or sections may be provided with suitable reinforcement or bracing. These have been omitted herein for the sake of clarity.

The wall 30 of FIG. 4 normally functions in the same manner as an ordinary concrete bearing wall. The building structure has been freed from the possibility of a chain reaction being triggered by the collapse of one or more bearing panels. This benefit is attained without the necessity of building additional strength into the structure as a whole.

I claim:

1. A large-panel concrete wall bearing component comprising a large concrete bearing panel to rest on a lower edge thereof on a support and to carry a load on an upper edge, said panel having at least one thin weakness band extending cross-sectionally between opposite faces of the bearing panel, said thin band comprising a plastic strip completely embedded in the concrete of the panel and having edges near but spaced inwardly from the panel faces and defining a portion of said bearing panel as a failure section, said thin band being weaker than the concrete of the bearing panel, and said failure section being of such size as to blow out of the panel along the weakness band when subjected to a blast while leaving enough of the bearing to continue to support said load.

2. A bearing component as claimed in claim 1 in which the weakness band of each failure section is spaced inwardly from the upper edge and two side edges of the bearing panel.

3. A bearing component as claimed in claim 2 in which each of said weakness bands is substantially of rectangular form having an upper edge and two side edges.

4. A bearing component as claimed in claim 2 comprising hinge means between an edge of the weakness section and the panel.

5. A bearing component as claimed in claim 4 in which said hinge means comprises a plurality of spaced-apart reinforcement bars embedded in the concrete of the bearing panel and each failure section thereof, said bars extending from the bearing panel into the failure section along one edge of the latter to act as a hinge therebetween in the event of a blow-out.

6. A large-panel concrete wall bearing component comprising a plurality of large concrete bearing panels formed in a wall resting on lower edges thereof on supports and respectively carrying loads on their upper edges; each of said panels having at least one thin weakness band extending cross-sectionally between opposite faces of the bearing panel, said thin band comprising a plastic strip completely embedded in the concrete of the panel and having edges near but spaced inwardly from the panel faces and defining a portion of said bearing panel as a failure section, each thin band being weaker than the concrete of the respective bearing panel, and each failure section being of such size as to blow out of the panel along the weakness band when subjected to a blast, while leaving enough of the bearing panel to continue to support said load.

7. A bearing component as claimed in claim 6 in which each of said weakness bands in spaced inwardly from the upper edge and two side edges of the respective bearing panel.

8. A bearing component as claimed in claim 7 in which each of said weakness bands is substantially of rectangular form having an upper edge and two side edges.

9. A bearing component as claimed in claim 7 comprising hinge means between an edge of each weakness section and the panel thereof.

10. A bearing component as claimed in claim 9 in which each hinge means comprises a plurality of spaced-apart reinforcement bars embedded in the concrete of the bearing panel and each failure section thereof, the bars of each bearing panel extending from the panel into the failure section along one edge of the latter to act as a hinge therebetween in the event of a blow-out.

11. A bearing component as claimed in claim 1, 2 or 3 in which said bearing panel has a plurality of laterally-spaced failure sections therein, the concrete of the bearing panel forming vertical support columns at the sides of the failure sections.

12. A bearing component as claimed in claim 9, 10 or 11 in which each of said bearing panels has a plurality of laterally-spaced failure sections therein, the concrete of the respective bearing panel forming vertical support columns at the sides of said failure sections.

13. A large-panel concrete wall bearing component comprising a plurality of large concrete bearing panels formed in a wall resting on lower edges thereof on supports and respectively carrying loads on their upper edges; each of said panels having at least one thin weakness band extending cross-sectionally between opposite faces of the bearing panel and defining a portion of said bearing panel as a failure section, each thin band being weaker than the concrete of the respective bearing panel, and each failure section being of such size as to blow out of the panel along the weakness band when subjected to a blast, while leaving enough of the bearing panel to continue to support said load, each of said weakness bands being spaced inwardly from the upper edge and the two side edges of the respective bearing panel, hinge means between an edge of each weakness section and the panel thereof, each hinge means comprising a plurality of spaced apart reinforcement bars embedded in the concrete of the bearing panel and each failure section thereof, the bars of each bearing panel extending from the panel into the failure section along one edge of the latter to act as a hinge therebetween in the event of a blowout.

* * * * *